United States Patent [19]

Osmond

[11] Patent Number: 4,701,733

[45] Date of Patent: Oct. 20, 1987

[54] POWER SUPPLY CIRCUIT INCLUDING A TRIP-SWITCH, AND AN ELECTRICAL OUTLET

[76] Inventor: Max R. V. Osmond, 66, avenue Max Dormoy, 94500 Champigny sur Marne, France

[21] Appl. No.: 862,879

[22] Filed: May 13, 1986

[30] Foreign Application Priority Data

May 14, 1985 [FR] France ..... 85 07293

[51] Int. Cl.[4] ..... H01H 73/00; H01H 73/12; H01H 75/00; H01H 83/06

[52] U.S. Cl. ..... 335/18; 335/174; 335/168; 335/164

[58] Field of Search ..... 335/128, 18, 14, 12, 335/11, 10, 21, 175, 174, 168, 170, 129, 192, 189, 164

[56] References Cited

U.S. PATENT DOCUMENTS 4,574,260 3/1986 Franks ..... 335/18

4,595,895 6/1986 Fujii ..... 335/168

*Primary Examiner*—E. A. Goldberg

*Assistant Examiner*—Lincoln D. Donovan

[57] ABSTRACT

An electricity power supply circuit including a trip switch having at least one fixed electrical contact (110, 111), a moving electrical contact (120, 121) facing the fixed electrical contact, a control member (130) movable between a working position in which the control member brings the moving electrical contact to bear against the fixed electrical contact and a rest position in which the moving contact is distant from the fixed contact, a holding spring (140) fixed to the control member, a cocking lever (150) movable between a locking position and an unlocking position, said lever including a notch (151) suitable for engaging said holding spring (140), a resilient member (160) suitable for urging the cocking lever towards the unlocking position, an electrical winding (170), and a magnetic body associated therewith.

9 Claims, 6 Drawing Figures

D4
D3
D2
D1
13
65
69
20
54
61
68
53
19
18
64
113
127
123
140
115
21
111
22
170
137
121
172
139
55
150
131
152
130
154
139
100
160
171
151
138
120
114
110
63
112
67
52
60
51
66
62
11
C1

POWER SUPPLY CIRCUIT INCLUDING A TRIP-SWITCH, AND AN ELECTRICAL OUTLET

The present invention relates to an electrical power supply circuit including a trip-switch.

The present invention is applicable to providing electrical power supply circuits including safety means, i.e. the trip-switch, in the form of a conventional electrical power outlet.

More precisely, the present invention seeks to improve the safety electrical power supply circuit described and shown in French patent application Ser. No. 81 03192 filed on Feb. 18, 1981, and published under the No. 2 500 210.

BACKGROUND OF THE INVENTION

Conventional electricity power mains comprises three live conductors at different phases together with a neutral conductor and a ground conductor, with the neutral conductor being connected to ground at the transformer for each main distribution sector.

Thus, a current outlet on the premises of any user for powering single-phase equipment comprises two power terminals one of which is connected to one of the live conductors and the other of which is connected to the neutral conductor, together with a third or ground terminal which is connected to a local ground and which is intended for connection to the chassis of the equipment plugged into said outlet.

In order to avoid any risk of electrocution when a person who is poorly insulated from ground touches said live conductor, safety devices have been proposed which comprise a trip-switch mounted at least on said live conductor and suitable for interrupting the supply of electricity at least to the corresponding terminal, together with a circuit for controlling the trip-switch.

The purpose of the trip-switch control circuit is to detect leakage currents which exceed a relatively low threshold (less than 6 mA at 200 volts AC) between the live conductor and the third or local ground terminal. To this end, the control circuit is sensitive to the potential difference which exists between the local ground and the ground at the main distribution transformer when said leakage current flows, by virtue of the non-zero resistance between said two points.

Various control circuits have thus been proposed which make use, in particular, of semi-conductor devices which constitute controlled switches, e.g. thyristors.

Above-mentioned French patent application No. 81 03192 also proposes a trip-switch control circuit constituted by a rectifier bridge whose inputs are connected to a general ground zero potential point at the main distribution transformer and to said third terminal or local ground terminal, and the positive and negative output terminals of the rectifier bridge feed a relay winding whose contact is connected in series with the winding of the trip-switch.

From the safety point of view, this arrangement is generally satisfactory.

However, heretofore it was not possible to integrate such a safety circuit including a trip-switch conveniently in an electricity outlet.

More precisely, it has heretofore not been possible to design a trip-switch which is simultaneously reliable, cheap, and small enough to be integrated in a housing for an electrical outlet of standard size.

The present invention seeks to improve this situation.

SUMMARY OF THE INVENTION

The present invention provides an electricity power circuit including a trip-switch, said circuit comprising at least:

- a fixed electrical contact;
- a moving electrical contact facing said fixed electrical contact and urged away therefrom by a resilient member;
- a moving control member movable between a working position in which said control member brings the moving electrical contact to bear against the fixed electrical contact, and a rest position in which said electrical contacts are separated, by virtue of said resilient member;
- a cocking lever movable between a locking position and an unlocking position;
- an elongate holding spring fixed to said control member and including at least one main arm which extends substantially parallel to the direction of cocking lever displacement, with said holding spring being fixed to said control member by said main arm, and an auxiliary arm which extends transversely to the direction of cocking lever displacement and which is engaged in a notch in said cocking lever when the cocking lever is moved to its locking position to hold the control member in its working position, the holding spring being relatively rigid in the direction of cocking lever displacement while being relatively flexible perpendicularly to the direction of cocking lever displacement;
- resilient bias means suitable for urging the cocking lever towards its unlocking position;
- an electrical winding; and
- a magnetic body displacable by said winding to disengage said holding spring from said cocking lever.

Such an electricity power supply circuit including a trip-switch in accordance with the present invention is both reliable and cheap, it may be made to be very small, and finally and above all it is very sensitive.

In accordance with the invention, the cocking lever is advantageously movable in translation between the above-mentioned locking position and unlocking position, and the notch provided therein has a bearing surface for the holding spring which extends perpendicularly to the direction of translation.

Tests have shown that it is advantageous to make the holding spring from piano wire, and also to mount the main arm of the holding spring pivotally on the control member.

Such pivotal mounting makes it possible, in particular to ensure that the holding spring is very flexible perpendicularly to the direction of lever displacement.

More precisely still, the presently preferred implementation of the invention has its holding spring formed by folding a piano wire type of wire into the following shape:

- an auxiliary branch which extends transversely to the direction of cocking lever translation and by which the holding spring engages the notch on the cocking lever, said auxiliary branch being extended by
- two main arms which extend substantially parallel to each other and to the direction of translation of the cocking lever;
- the far end of each main arm from said auxiliary branch having a respective loop provided thereat, whereby the holding spring is pivotally mounted on the control member; and respective return fingers project from said loops which engage the control member to urge the auxiliary branch to press against the cocking lever.

Advantageously, the coil axis extends perpendicularly to the cocking lever.

Also, and preferably, an actuator armature is pivotally mounted between the holding spring and the magnetic body.

Also advantageously, the magnetic body is in the form of a plunger core comprising a main body which is axially extended by a peg of smaller cross-section.

BRIEF DESCRIPTION OF THE DRAWINGS

An embodiment of the invention is described by way of example with reference to the accompanying drawings, in which.

MORE DETAILED DESCRIPTION

Figure 1:
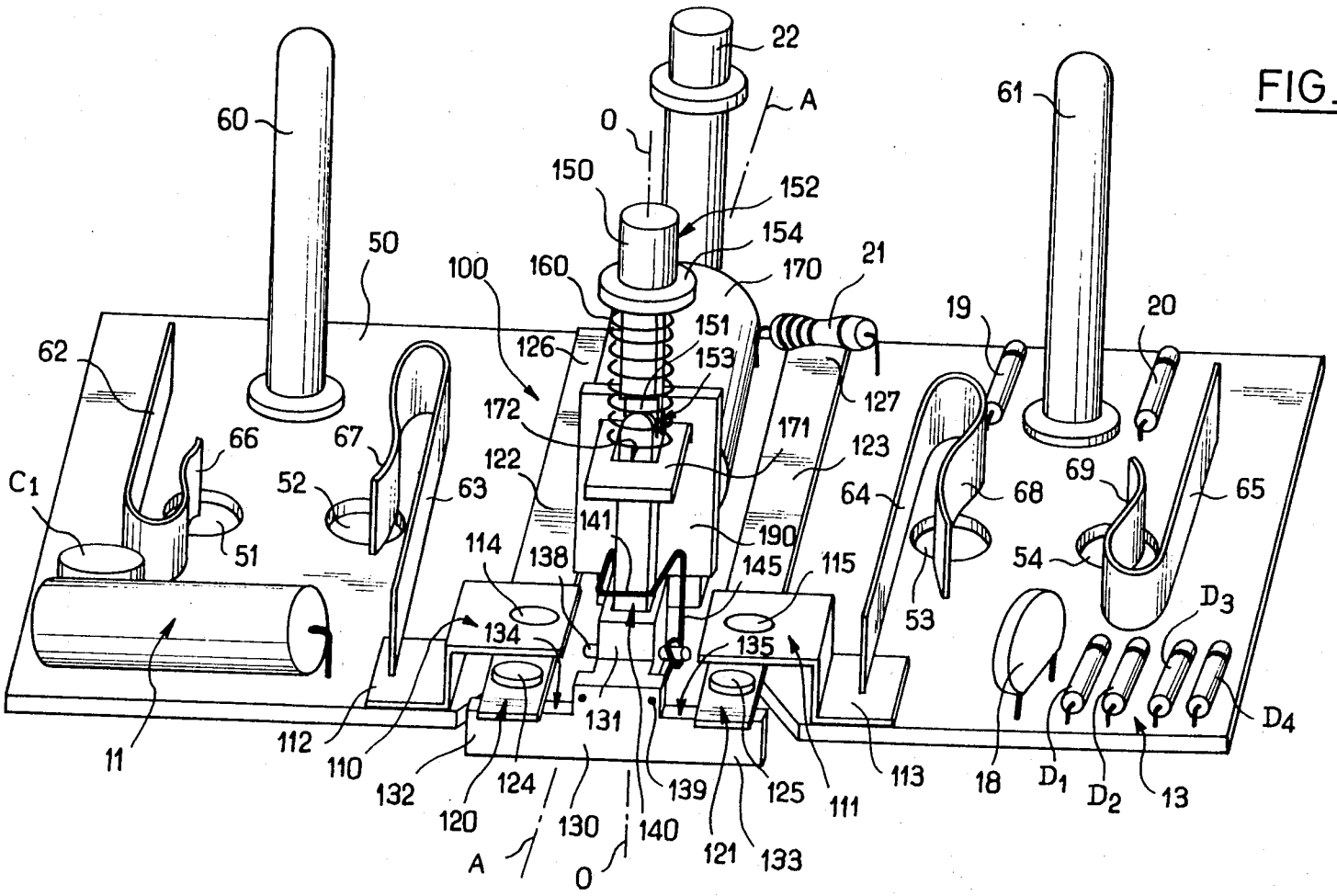
FIG. 1 is an overall perspective view of an electricity supply device including a trip-switch and in accordance with the invention, shown with its control member in the rest position (no power supply)
Figure 2:
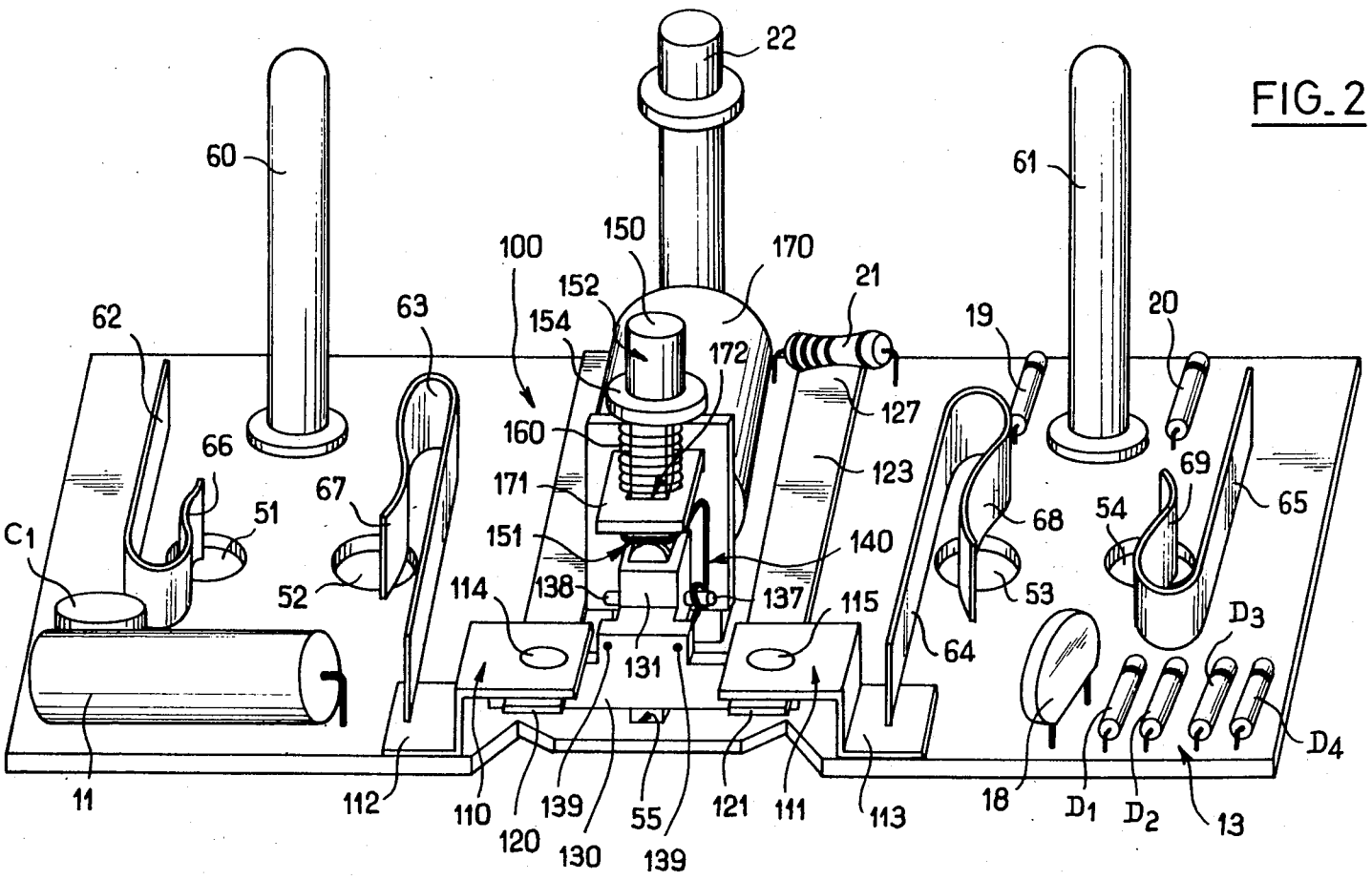
FIG. 2 is a similar overall perspective view to FIG. 1, showing the control member in its operating position (electricity supplied)

FIGS. 1 and 2 show a plate 50 of insulating printed circuit board material having a trip-switch 100 mounted thereon together with the components of a circuit for controlling the trip-switch. The trip-switch is described in greater detail below.

The control circuit may be the trip-switch control circuit as described in the above-mentioned French patent application filed under the No. 81 3192. Since it is already described in said prior published application, this particular trip-switch controlling circuit is not described in greater detail herein. It should be understood that this circuit is merely one specific example of the possible circuits that could be used.

As shown in FIGS. 1 and 2, the trip-switch controlling circuit comprises the following components:

a housing 11 for a relay which controls the winding of the trip-switch 100;

a rectifier bridge 13 comprising four diodes $D_1$, $D_2$, $D_3$, and $D_4$ connected in a conventional fullwave rectifier configuration. As mentioned in French patent application No. 81 3192, the input terminals of rectifier bridge 13 should be connected to the general ground zero potential point at the main distribution transformer and to the local ground terminal. The positive and negative outputs from the rectifier bridge 13 are connected to the coil of the above-mentioned relay 11;

a non-linear conductor element 18, e.g. a metal oxide varistor connected across the inputs of the rectifier bridge 13. The purpose of this non-linear element 18 is to limit the voltage which may appear across the input terminals of the rectifier 13 in order to avoid damaging it;

a test circuit comprising two diodes 19 and 20, a resistor 21 and a pushbutton or switch 22. The anodes of the diodes 19 and 20 are respectively connected to the live conductor and to the neutral conductor of the equipment powered from the outlet, and their cathodes are interconnected. The diodes 19 and 20 are thus mounted head-to-tail with the common points of the cathodes being connected to the conductor going to the equipment ground of the equipment connected to the outlet via the resistor 21 and the pushbutton or switch 22.

It may be observed that the references used for the above components correspond to the references used in French application No. 81 3192.

Reference can usefully be made to said prior patent specification in order to obtain a complete understanding of how the trip-switch control circuit works.

Where applicable, capacitors may be connected to the terminals of the winding of relay 11 and to its electrical contacts.

Thus, by way of illustration, FIGS. 1 and 2 show a capacitor $C_1$ suitable for being connected to the terminals of the contacts of relay 11.

The printed circuit board 50 also bears the electrical contacts of the outlet. More precisely, and as shown in FIGS. 1 and 2, the circuit board 50 is disposed to provide two electrical outlets connected in parallel. Naturally, the number of outlets provided on a single board, and the specific physical configuration of each outlet can be varied to suit customer requirements.

Thus, FIG. 1 shows two male ground pins 60 and 61, each of which is associated with a corresponding pair of curved and flexible electrical conductor blades 62 and 63 or 64 and 65 as the case may be.

Each of said pairs of blades (62 and 63, or 64 and 65) comprises one live conductor and one neutral conductor each passing via the trip-switch. These electrical connections are provided using conventional screw terminals, for example, which are mounted on the opposite face of the printed circuit board 50 (i.e. on the face which is not shown in the drawings).

Each of the contact blades 62, 63, 64, and 65 is essentially constituted by a plane branch via which the blade is fixed to the printed circuit board 50 and is electrically connected to the appropriate mains wire, and a curved flexible end respectively referenced 66, 67, 68, or 69 as the case may be, and intended to come into contact, in use, with the male pins of a complementary plug which is electrically connected to equipment making use of the outlet.

In order to make this possible, it will be observed that the flexible curved ends, 66, 67, 68, and 69 of the electrical conductor blades are disposed over respective orifices, 51, 52, 53, 54 through the printed circuit board 50.

The electrically conductive blades 62 and 64 are connected to each other as are the electrically conductive blades 63 and 65. This is done by electrical conductors disposed on the opposite (and not visible) face of the printed circuit board 50.

There follows a description of the trip-switch 100 in accordance with the present invention.

The main components of the trip-switch are as follows:

two fixed electrical contacts 110 and 111;

two moving electrical contacts 120 and 121 disposed opposite said fixed electrical contacts;
a moving control member 130;
a holding spring 140;
a cocking lever 150;
resilient bias means 160;
an electrical winding 170;
a plunger core 180; and
an actuator armature 190.

It may be observed that the trip-switch is symmetrical about a plane which extends perpendicularly to the printed circuit board 50 and which passes through the axis 0—0 of the cocking lever 150 and the axis A—A of the winding 170, which axes 0—0 and A—A are mutually perpendicular.

The two fixed electrical contacts 110 and 111 are disposed symmetrically about said plane and are constituted by folding electrically conductive blades 112 and 113 which are fixed to the printed circuit 50 and which carry respective electrical contact tabs 114 and 115 which stand proud from the printed circuit board 50.

The blade 112 is connected to conductor blades 63 and 65, while the blade 113 is connected to electrical conductor blades 62 and 64.

The moving electrical contacts 120 and 121 are in the form of flexible blades 122 and 123 which are generally plane and straight in shape and which are disposed symmetrically about said plane. Respective first ends 126 and 127 of the blades 122 and 123 are fixed to the printed circuit board 50 and respective second ends of said blades disposed opposite said tabs 114 and 115 carry electrical contact tabs 124 and 125 for making contact therewith.

The blades 122 and 123 are disposed in such a manner that the residual elasticity thereof (which constitutes the above-mentioned resilient member) urges the moving tabs 124 and 125 away from the fixed tabs 114 and 115.

The blade 122 is connected to the neutral conductor while the other blade 123 is connected to the live conductor by screw terminals disposed on the hidden face of printed circuit board 50.

The control member 130 comprises a main body 131 having two aligned fins 132 and 133 projecting therefrom symmetrically about said plane O-O-A-A and perpendicularly thereto. Said fins are disposed beneath the blades 122 and 123, i.e. on the opposite sides of the moving electrical contacts 120 and 121 relative to the fixed electrical contacts 110 and 111.

Thus, the blades 122 and 123 of the moving electrical contacts 120 and 121 rest on coplanar surfaces 134 and 135 of the fins 132 and 133.

The body 131 of the control member has a bore 136 which extends perpendicularly to the printed circuit board 50 and which is of complementary cross-section to the cocking lever 150 in order to guide said lever to move in translation along the axis O—O perpendicularly to the printed circuit board 50.

Further, the body 131 of the control member has two lugs 137 and 138 which are symmetrically disposed about the plane O-O-A-A, which extend perpendicularly thereto, and which pivotally support the holding spring 140.

The holding spring 140 is made by folding a piano-wire type of wire into the following shape:

an auxiliary branch 141 which extends transversely to the direction O—O in which the cocking lever 150 moves (and perpendicularly to the plane of symmetry O-O-A-A), by which the holding spring is engaged in a notch 151 made in the cocking lever 150;
the auxiliary branch 141 is extended by means of two symmetrically disposed arms 142 and 143 which are symmetrical about and substantially parallel with the plane of symmetry O-O-A-A and which are perpendicular to the axis O—O of the cocking lever 150;
the arms 142 and 143 are extended by two main branches 144 and 145 which are substantially parallel to each other and to the direction O—O in which the cocking lever 150 is moved;
two loops 146 and 147 provided at the ends of the main branches 144 and 145 which are furthest from the auxiliary branch 141, and which are pivotally mounted on the above-mentioned lugs 137 and 138 in order to guide the holding spring so that it pivots on the control member 130; and
two return fingers 148 and 149 projecting from the loops 146 and 147 respectively and extending substantially parallel to each other and symmetrically about the plane of symmetry O-O-A-A and perpendicularly to the axis O—O in which the cocking lever 150 moves, said fingers being engaged in the member 130 to urge the auxiliary branch 141 of the holding spring to press against the cocking lever 150.

Figure 3:
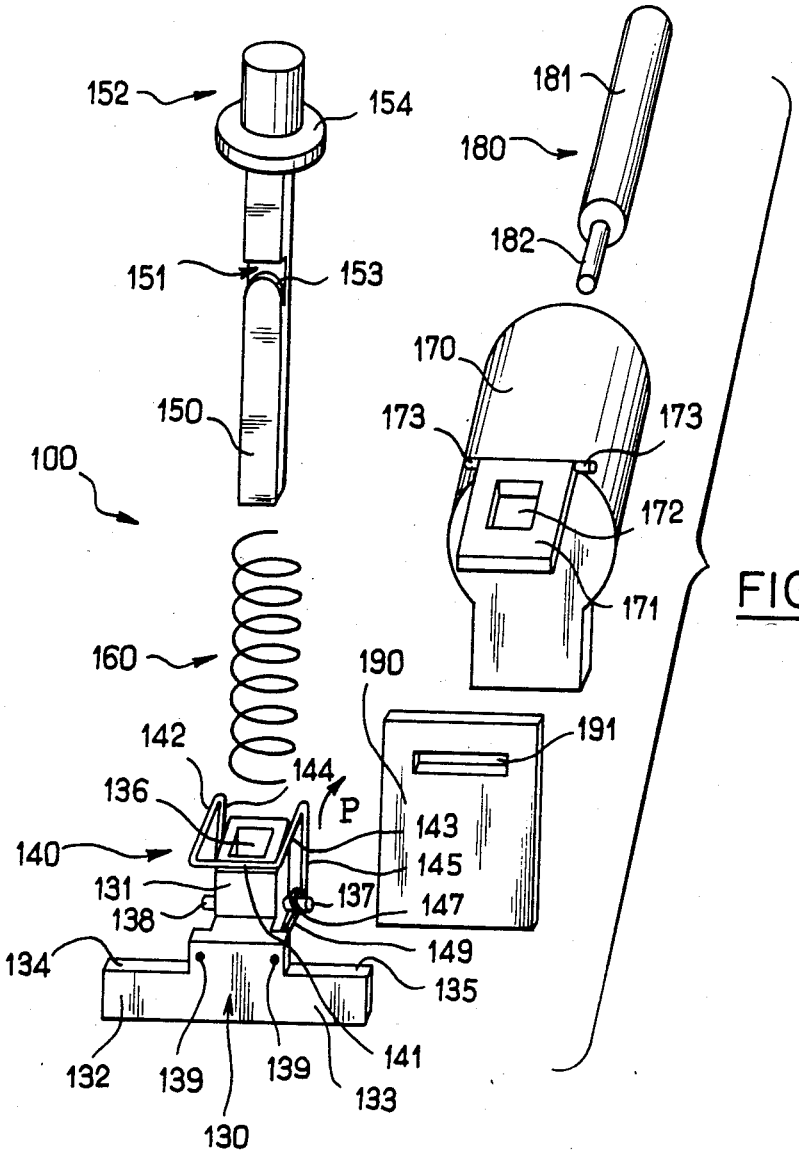
FIG. 3 is a diagrammatic exploded perspective view of a trip-switch in accordance with the present invention.
Figure 4:
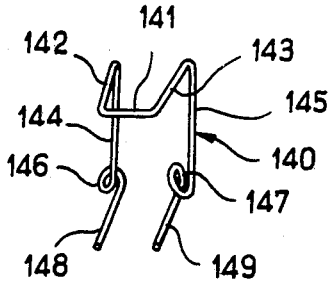
FIG. 4 is a diagrammatic perspective view of a holding spring integrated in a trip-switch in accordance with the present invention.

More precisely, and as can be seen in FIGS. 3 and 4, the free ends of the return fingers 148 and 149 are engaged in respective orifices 139 provided in the control member 130.

Thus, the residual elasticity of the holding spring 140 urges the auxiliary branch 141 to press against the cocking lever 150 in the direction shown diagrammatically by arrow P in FIG. 3.

The cocking lever 150 is in the form of a rectilinear rod which is guided to move along the axis O—O in the bore 136 through the control member 130.

Further, the cocking lever 150 is advantageously guided along the axis O—O by an orifice 55 through the printed circuit board 50 and by an orifice 172 through a plate 171 which is fixed to the support for the electric winding 170 and which extends substantially perpendicularly to the axis O—O.

The right cross-section of the cocking lever 150 is advantageously complementary to the right cross-section of the bore 136 and of the orifices 55 and 172.

Generally speaking, and as shown in the figures, this section is square. However, other sections could alternatively be used.

The use of a non-round section serves, in particular, to prevent the cocking lever 150 from rotating about its longitudinal axis O—O.

The top end 152 of the cocking lever 150 is suitable for being pushed by the finger of a user in order to cock the trip-switch as described in greater detail below.

Part of the way along the cocking lever 150 there is a transverse notch 151 for receiving the auxiliary branch 141 of the holding spring 140 when the lever 150 is moved to its locking position, as shown in FIG. 2, in which it holds the control member 130 in its working position.

When the cocking lever 150 is not prevented from rotating about its own longitudinal axis, the notch 151 may be provided in the form of a neck running all the way round the lever.

As shown diagrammatically in the figures, the notch 151 has a bearing surface 153 for the holding spring which extends substantially perpendicularly to its direction of movement O—O.

More precisely, as appears from the figures, the bearing surface 153 is generally curved and convex in shape about an axis lying in the plane of symmetry O—O—A—A and extending perpendicularly to the axis O—O along which the cocking lever 150 moves.

This advantageous disposition defines a contact point between the bearing surface 153 and the auxiliary branch 141 of the holding spring 140 made of piano wire. This characteristic prevents the holding spring 140 from catching the cocking lever 150 inopportunely, makes it easy to release the cocking lever 150 when the auxiliary branch 141 of the holding spring is displaced by the armature 190 against its residual elasticity, and thus guarantees that a trip-switch in accordance with the invention is highly sensitive.

The resilient bias means 160 are constitited by a helical spring interposed between the above-mentioned plate 171 and fixed to the support of the electrical winding 170 and to an annular rib 154 which is integral with the cccking lever and is located near the top end 152 thereof.

The helical spring 160 is suitable for urging the cocking lever 150 towards its non-locking position as shown in FIG. 1, i.e. to a position distant from the printed circuit board 50 and the control member 130.

The electrical winding 170 is disposed on a support which is fixed to the above-mentioned plate 171.

The axis A—A of the electrical winding is disposed in the plane of symmetry of the circuit-breaker and extends perpendicularly to the axis O—O along which the cocking lever 150 moves.

The winding 170 has an internal bore (not visible in the figures) which guides the plunger core 180 made of ferro-magnetic material in translation along the above-mentioned axis A—A. The plunger 180 is advantageously constituted by a cylindrical main body 181 which is axially extended at its cocking lever end by a peg 182 of smaller cross-section.

Thus, when the electrical winding 170 is powered, the main body 181 of the plunger is drawn into the winding. The peg 182 projects beyond the winding and unlocks the holding spring 140 and thus the cocking lever 150 by means of the armature 190.

More precisely, the actuator armature 190 which extends particularly to the plane of symmetry O-O-A-A of the trip-switch has a rectilinear window 191 through which the armature 190 is engaged on the plate 171 in order to allow the armature 190 to pivot about an axis perpendicular to the plane of symmetry O-O-A-A, e.g. against lugs fixed to said plate 171. The lugs 173 extend perpendicularly to the plane of symmetry O-O-A-A and could be replaced by a single lug projecting upwardly from the plate 171, having its axis in said plane of symmetry, thereby making the part easier to unmold.

Figure 5:
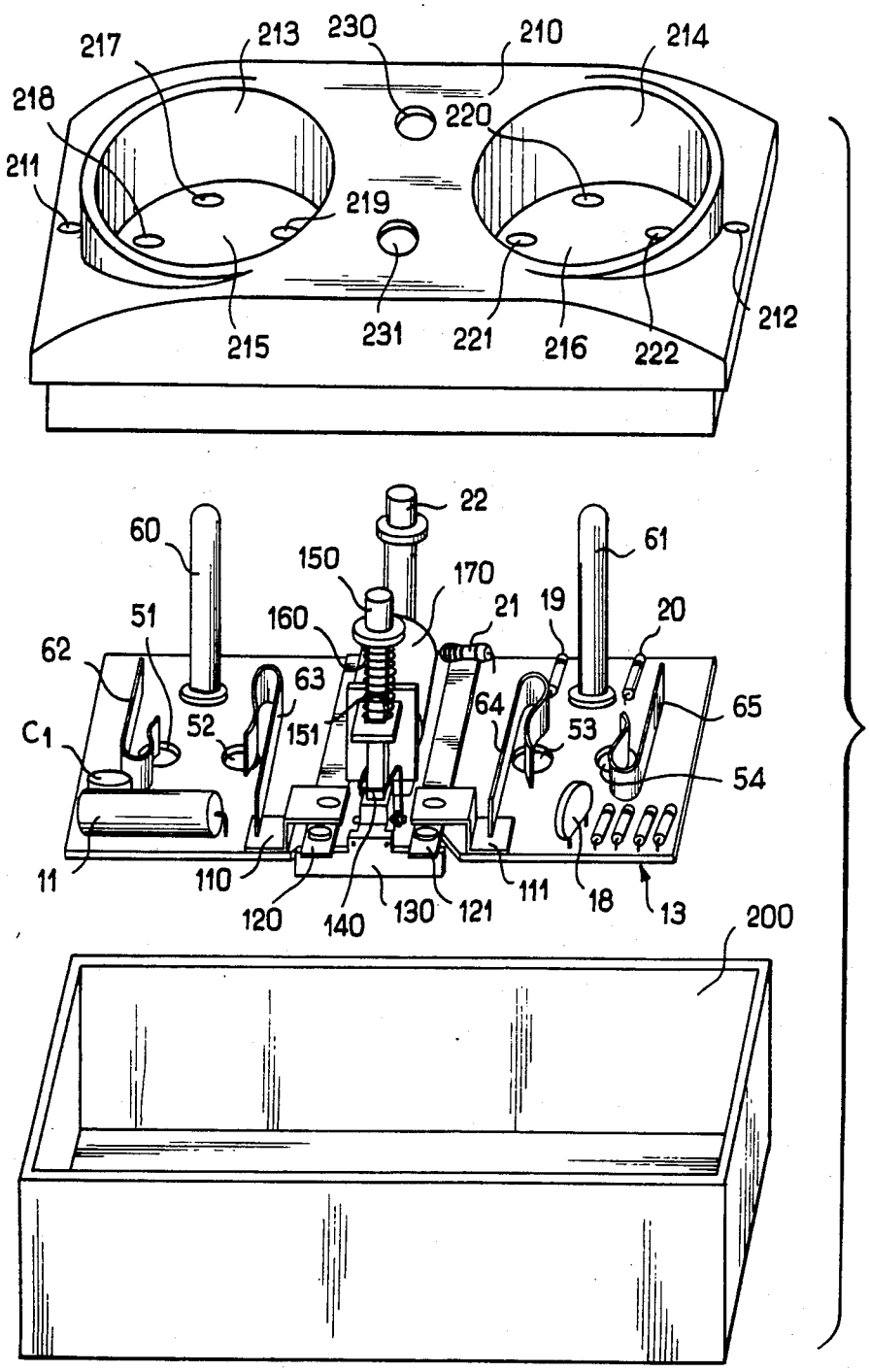
FIG. 5 is a diagrammatic perspective exploded view of a two-outlet electricity-supplying receptacle including a trip-switch in accordance with the present invention.

FIG. 5 is a diagram of a housing suitable for receiving the printed circuit board 50 and the above-described components.

More precisely, FIG. 5 shows a housing 200 suitable for receiving a printed circuit board 50 together with its components, and a lid 210.

The lid 210 is fixed to the housing 200 by means of screws passing through orifices 211 and 212 passing through the lid 210.

The front face of the lid 210 has two cylindrical blind cavities or receptacles 213 and 214 for receiving respective complementary plug bodies which are electrically connected to equipment that draws its power from said receptacles.

The bottom 215 or 216 of each plug-receiving recess 213 or 214 has three orifices 217, 218 and 219 or 220, 221 and 222 disposed respectively for passing the male pins 60 or 61 or for passing pins to engage in the orifices 51, 52 or 53, 54.

The orifices 217 and 220 are intended to receive the male pins 60 and 61, whereas the orifices 218, 219 and 221, 222 are intended to receive male pins on the complementary plugs.

Finally, it may be observed in FIG. 5 that two orifices 230 and 231 are provided in the front face of the lid 210 and are intended, respectively, to receive the top end of the test pushbutton 22 and the top end of the cocking lever 150.

There follows a description of the operation of a trip-switch device in accordance with the present invention.

In the rest position shown in FIG. 1 the holding spring 140 does not have its auxiliary branch 141 engaged in the notch 151 of the cocking lever 150, and consequently the helical spring 160 urges the cocking lever 150 away from the control member 130, thereby allowing the control member 130 to be thrust against the printed circuit board 50 by the resilience of the contact blades 122 and 123, thus moving the tabs 124 and 125 of the moving contacts away from the tabs 114 and 115 respectively of the fixed contacts and so depriving the flexible electrical contact blades 62, 63, 64, and 65 from being supplied with electricity.

Naturally the electrical winding 170 is unpowered, the main arms 144 and 145 of the holding spring 140 urge the actuator armature 190 against the electrical winding 170, and consequently the peg 182 at the end of the plunger core 180 is pushed back into the winding 170 by the actuator armature 190.

In order to cock the trip-switch, the cocking lever must be pushed along its axis 0—0 against the helical spring 160.

When the notch 151 of the cocking lever 150 comes level with the auxiliary branch 141 of the holding spring 140, the auxiliary branch drops into the notch 150 by virtue of the resilience of the spring 140.

Thereafter, when the cocking lever 150 is released, the helical spring 160 again urges the cocking lever 150 away from the printed circuit board 50 and simultaneously displaces the control member 130 since the auxiliary branch 141 of the holding spring 140 is held prisoner in the notch 151 by bearing against the above-mentioned surface 153.

Moving the control member 130 along the axis 0—0 causes the contact tabs 124 and 125 to move resiliently against the tabs 114 and 115.

The electrical contact blades 62, 63, 64, and 65 are then powered via the tabs 114 and 124 or 115 and 125 as the case may be.

The device is then ready for use.

When a potential difference between the ground conductor and the equipment ground terminal due to a fault is detected by the rectifier bridge 13, a DC voltage appears across the output terminals of the rectifier bridge thereby powering the winding of the relay 11 which feeds the electrical winding 170.

Consequently, the body 181 of the plunger core 180 is drawn into the electrical winding 170, the peg 182 then emerges from the front of the electrical winding 170 and causes the actuator armature 190 to pivot about an axis perpendicular to the plane of symmetry O-O-A-A, thereby causing the armature 190 to press against the main arms 144 and 145 of the holding spring 140 and causing it to pivot by bending at the loops 146 and 147, the auxiliary branch 141 of the holding spring 140 then leaves the notch 151 thus releasing the cocking lever 150, thereby allowing the helical spring 160 to move the cocking lever 150 away from the printed circuit board 50 and releasing the control member 130 so that the resilient blades 122 and 123 urge it away from the cocking lever 150, thus separating the pairs of contact tabs 114, 124 and 115, 125.

The trip-switch device thus returns to the initial position shown in FIG. 1 and the electrical contacts 62, 63, 64 and 65 are no longer powered.

It may be observed that the above-mentioned arrangement of the holding spring 140 which is made by folding piano wire, or the like, ensures that the spring is very stiff in the direction of movement of the cocking lever 150 while being very flexible perpendicularly to the direction of lever movement.

This disposition guarantees both that the holding spring is securely locked in the notch 151 of the cocking lever 150, and also ensures that the spring 160 is released by the relatively low energy delivered by the electrical winding 170. Furthermore, in a variant of the invention, this winding need no longer be powered directly by the relay contact, but via two thyristors connected in a circuit as shown in FIG. 6.

This circuit is intended to increase the controlled power and also to increase its reliability.

Figure 6:
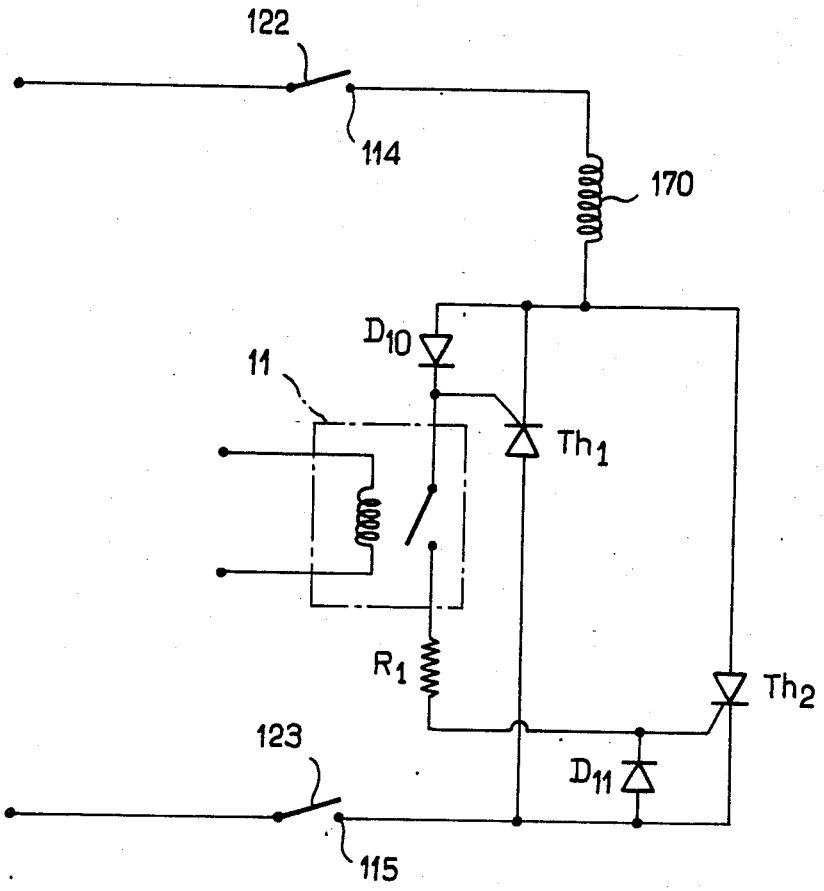
FIG. 6 is a circuit diagram showing a variant trip-switch control circuit.

FIG. 6 shows two thyristors $Th_1$ and $Th_2$ which are connected head-to-tail in parallel, with said parallel connection being connected in series with the winding 170 between the neutral wire and the live wire, downstream from the trip-switch.

The relay contact 11 is disposed between the triggers of the thyristor $Th_1$ and $Th_2$, by means of a resistor $R_1$.

In addition, the diodes $D_{10}$ and $D_{11}$ are respectively associated with the thyristors, such that the cathodes of the diodes $D_{10}$ and $D_{11}$ are connected to the thyristor triggers and the anodes of the diodes $D_{10}$ and $D_{11}$ are connected to the thyristor cathodes.

Naturally the present invention is not limited to the particular embodiment which is described above, and it extends to any variant which falls within the scope of the claims.

It may be observed, in particular, that the disposition of the electrical winding 170, the plunger core 180 associated therewith, and the actuator armature 190 may be varied in many ways.

The symmetrical disposition of the trip-switch 100 avoids the need for any adjustment.

Furthermore, installing all of the components of the trip-switch 100 and the control device therefor on a common circuit-board 50 greatly facilitates assembly.

The dispositions proposed by the present invention can be used to control electrical contacts which are either open or closed in the rest position.

I claim:

1. An electricity power supply circuit including a trip switch, said circuit comprising at least:

a fixed electrical contact;

a movable electrical contact facing said fixed electrical contact and urged away therefrom by a resilient member;

a control member movable between a working position in which said control member brings the moving electrical contact to bear against the fixed electrical contact, and a rest position in which said electrical contacts are separated, by virtue of said resilient member;

a cocking lever movable between a locking position and an unlocking position;

an elongate holding spring fixed to said control member and including at least one main arm which extends substantially parallel to the direction of cocking lever displacement, with said holding spring being fixed to said control member by said at least one main arm, and an auxiliary arm which extends transversely to the direction of cocking lever displacement and which is engaged in a notch in said cocking lever when the cocking lever is moved to its locked position to hold the control member in its working position, the holding spring being relatively rigid in the direction of cocking lever displacement while being relatively flexible perpendicularly to the direction of cocking lever displacement;

resilient bias means suitable for urging the cocking lever towards its unlocked position;

an electrical winding; and a magnetic body displacable by said winding to disengage said holding spring from said cocking lever.

2. An electricity power supply circuit according to claim 1, wherein the cocking lever is movable in translation between the locking position and the unlocking position, and the notch provided in the cocking lever has a bearing surface for engaging the holding spring which extends perpendicularly to the direction of cocking lever translation.

3. An electricity power supply circuit according to claim 1, wherein the main arm of the holding spring is pivotally mounted on the control member.

4. An electricity power supply circuit according to claim 1, wherein the holding spring is made from piano wire.

5. An electricity power supply circuit according to claim 1, wherein the holding spring is made by bending a piano wire type of wire into the following shape:

an auxiliary branch which extends transversely to the direction of cocking lever translation and by which the holding spring engages the notch on the cocking lever, said auxiliary branch being extended by two main arms which extend substantially parallel to each other and to the direction of translation of the cocking lever;

the far end of each main arm from said auxiliary branch having a respective loop provided thereat, whereby the holding spring is pivotally mounted on the control member; and respective return fingers project from said loops which engage the control member to urge the auxiliary branch to press against the cocking lever.

6. An electricity power supply circuit according to claim 1, wherein the axis of the winding extends perpendicularly to the cocking lever.

7. An electricity power supply circuit according to claim 1, wherein an actuator armature is pivotally mounted between the holding spring and the magnetic body.

8. An electricity power supply circuit according to claim 1, wherein the magnetic body is a plunger core comprising a main body which is axially extended by a peg of small cross-section.

9. In combination with an electrical receptacle comprising a housing for enclosing a power supply circuit including a trip-switch as defined in claim 1, a trip-switch control device.

* * * * *